US006257506B1

(12) United States Patent
Hofmann et al.

(10) Patent No.: US 6,257,506 B1
(45) Date of Patent: Jul. 10, 2001

(54) FUEL INJECTOR FOR AUTO-IGNITION INTERNAL COMBUSTION ENGINES

(75) Inventors: Karl Hofmann, Remseck; Friedrich Boecking, Stuttgart, both of (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/355,775

(22) PCT Filed: Jun. 19, 1998

(86) PCT No.: PCT/DE98/01696

§ 371 Date: Sep. 13, 1999

§ 102(e) Date: Sep. 13, 1999

(87) PCT Pub. No.: WO99/30028

PCT Pub. Date: Jun. 17, 1999

(30) Foreign Application Priority Data

Dec. 11, 1997 (DE) ..... 197 55 057

(51) Int. Cl.[7] ..... F02M 59/00

(52) U.S. Cl. ..... 239/533.2; 239/533.9; 239/533.12; 239/585.5

(58) Field of Search ..... 239/533.2–533.11, 239/88–92, 585.5

(56) References Cited

U.S. PATENT DOCUMENTS 2,927,737 * 3/1960 Zeuch et al. ..... 239/533.3
3,836,080 * 9/1974 Butterfield et al. ..... 239/533.4
4,153,205 * 5/1979 Parrish, Jr. ..... 239/533.9
4,470,548 * 9/1984 Ushimura ..... 239/533.3
5,890,660 * 4/1999 Stevens ..... 239/233.9
5,899,389 * 5/1999 Pataki et al. ..... 239/533.9

* cited by examiner

*Primary Examiner*—David A. Scherbel
*Assistant Examiner*—Dinh Q. Nguyen
(74) *Attorney, Agent, or Firm*—Ronald E. Greigg; Edwin E. Greigg

(57) ABSTRACT

A fuel injection nozzle for self-igniting internal combustion engines, having a nozzle body, in which a conical seat face from which injection ports originate is formed at the bottom of a blind bore. A valve needle which is guided displaceably with a guide portion in the inlet region of the blind bore counter to a closing force and counter to the fuel flow direction and on the end of a valve shaft adjoining the guide portion has a closing cone cooperating with the seat face. The valve shaft circumferentially defines an annular chamber for fuel delivery, and is characterized in that in a transitional region between the valve shaft and the closing cone, a throttle device of variable throttle cross section is disposed, by which the injection cross section can be varied as a function of the axial displacement of the valve needle.

13 Claims, 4 Drawing Sheets

FUEL INJECTOR FOR AUTO-IGNITION INTERNAL COMBUSTION ENGINES

PRIOR ART

The invention relates to a fuel injection nozzle for self-igniting internal combustion engines, having a nozzle body, in which a conical seat face from which injection ports originate is formed at the bottom of a blind bore. A valve needle which is guided displaceably with a guide portion in the inlet region of the blind bore counter to a closing force and counter to the fuel flow direction and on the end of a valve shaft adjoining the guide portion has a closing cone cooperating with the seat face. The valve shaft circumferentially defines an annular chamber for fuel delivery. Such fuel injection nozzles are disclosed for instance in German published, non-examined Patent Application DE-OS 37 34 587 and German Utility Model 93 0 992.0.

In the fuel injection nozzle disclosed by DE-OS 37 34 587, in order to prevent the so-called blowback of the combustion gases, a control passage for the injection fuel is provided that is varied by the valve needle as a function of the stroke and whose flow cross section decreases in the closing stroke of the valve needle, down to a throttle cross section that decouples the relief wave on the pump side from the fuel pressure in the blind bore.

In the fuel injection nozzle disclosed in German Utility Model 93 01 992.0, a guide sleeve that surrounds the valve shaft and has a conically embodied face end and, in its portion near the conical face end, a plurality of recesses extending as far as the conical face end prevents the closing cone from covering some or all of the injection ports as a consequence of play or eccentricity of the valve needle, or if lateral forces in a short opening stroke act on the valve needle, which coverage would impair the combustion process.

One problem of such fuel injection nozzles is that even a short stroke of the valve needle results in large flow quantities. Especially in the pre-stroke range, the stroke-dependent characteristic curve of the flow is very steep.

Aside from deleterious combustion events, this is also problematic because different fuel injection nozzles with different tolerances thus produce very different flow quantities, with the same stroke.

It has furthermore been demonstrated that a graduated injection, or at least one that increases slowly at the injection onset, in general leads to an improvement in the emissions figures of the engines.

It is therefore the object of the invention to refine a fuel injection nozzle of this generic type in such a way that an aforementioned production tolerances, particularly in the range of the prestroke, do not deleteriously affect the injection event, and that at least at the injection onset, a slowly increasing injection is attained.

ADVANTAGES OF THE INVENTION

This object is attained, in a fuel injection nozzle of the type described at the outset, in that in the transitional region between the valve shaft and the closing cone, a throttle device of variable throttle cross section is disposed, by which the injection cross section can be varied as a function of the axial displacement of the valve needle.

The disposition of this kind of throttle device has the particularly great advantage that not only can the injection cross section be varied thereby in such a way that it increases continuously at the onset of the injection event, but also that the injection cross section can be varied in such a way that particularly in the prestroke range, only slight flow changes occur during a stroke motion of the valve needle, and as a consequence, production tolerances are much less disruptive than in known fuel injection nozzles.

As to the embodiment of the throttle device, the most various versions are conceivable.

One advantageous version provides that the throttle device includes a shoulder, formed in the annular chamber, and a control edge disposed adjacent to it and spaced apart from it on the valve shaft, which control edge is adjoined downstream by at least one conical face. By means of the shoulder, the control edge spaced apart from it, and the at least one conical face adjoining the control edge downstream thereof, a throttle with a throttle cross section that decreases as a result of axial displacement of the valve needle is made possible in a way that is highly advantageous, because it is technologically easy to accomplish.

One advantageous version provides that the control edge substantially faces the shoulder. As a result, a defined initial throttle cross section is advantageously realized.

In another advantageous version, the control edge is disposed slightly downstream of the shoulder. As a result, upon a slight axial displacement, the initial throttle cross section is kept unchanged at first, until the control edge overtakes the shoulder.

With regard to the conical face adjoining the control edge, once again the most various versions are conceivable.

The conical face is advantageously defined as a function of the disposition of the control edge opposite the shoulder.

Thus one advantageous version provides that the conical face adjoining the control edge has a smaller cone angle than the conical seat face. As a result, in cooperation with the initial throttle cross section determined by the spacing of the control edge from the shoulder, an initial throttling of the injected fuel quantity is attained in which the conical seat face of the valve needle is also, in a highly advantageous way, included in the throttling process.

It is moreover also possible for the conical face adjoining the control edge to have a larger cone angle than the conical seat face.

In a further exemplary embodiment of a throttle device, which is advantageous in terms of its manufacture, it is provided that a sleeve axially displaceable counter to the restoring force of a spring is disposed in the annular chamber and rests with a conically embodied face end on the outer annular face of the conical seat face, and in it, at least two openings of different opening cross sections are provided that can be uncovered in succession by axial displacement of the valve needle. Such a sleeve has the very great advantage in particular that it is not only easy to make but is also easy to assemble, especially even outside the nozzle body.

As to the disposition and embodiment of the openings of different opening cross section that can be uncovered in succession by axial displacement of the valve needle, they can purely in principle have the most various shapes. One advantageous version provides that a first opening is disposed above a control edge, formed on the valve shaft, in the jacket of the sleeve, and a second opening whose opening cross section is smaller than that of the first opening is disposed below the control edge embodied on the valve shaft. The opening provided in the conical face then thus takes on the task of initial throttling, while conversely the opening provided in the jacket enables a valve needle stroke-dependent decrease in the throttle cross section as a result of axial displacement of the valve needle. The opening provided in the jacket may be elliptical, oval, round, triangular, quadrilateral, or polygonal in shape.

In another advantageous version it is provided that two rows of perforations one above the other are disposed in the jacket of the sleeve, and the downstream row of perforations has a smaller total opening cross section than the upstream row of perforations. This version of the throttle device advantageously enables filtering of the injected fuel cross section.

Another advantageous version provides that a sleeve axially displaceable counter to the restoring force of a spring is disposed in the annular chamber and rests with a conically embodied face end on the outer annular face of the conical seat face and that facing the sleeve in the valve shaft is at least one recess, cooperating with the sleeve, whose opening cross section, on the end of the sleeve toward the guide portion, increases steadily toward the conical seat face.

Yet another advantageous version provides that a sleeve which can be slaved by an axial displacement of the valve needle and is axially displaceable counter to the restoring force of a spring is disposed in the annular chamber and rests with a conically embodied face end on the outer annular face of the conical seat face, and its conically embodied face end has at least one recess that is open toward the face end.

In this last version, the sleeve is especially easy to make, with only a few production steps.

BRIEF DESCRIPTION OF THE DRAWINGS

Further characteristics and advantages of the invention are the subject of the ensuing description and are shown in several exemplary embodiments in the drawings.

Shown in the drawings are.

DESCRIPTION OF THE EXEMPLARY EMBODIMENTS

Figure 1:
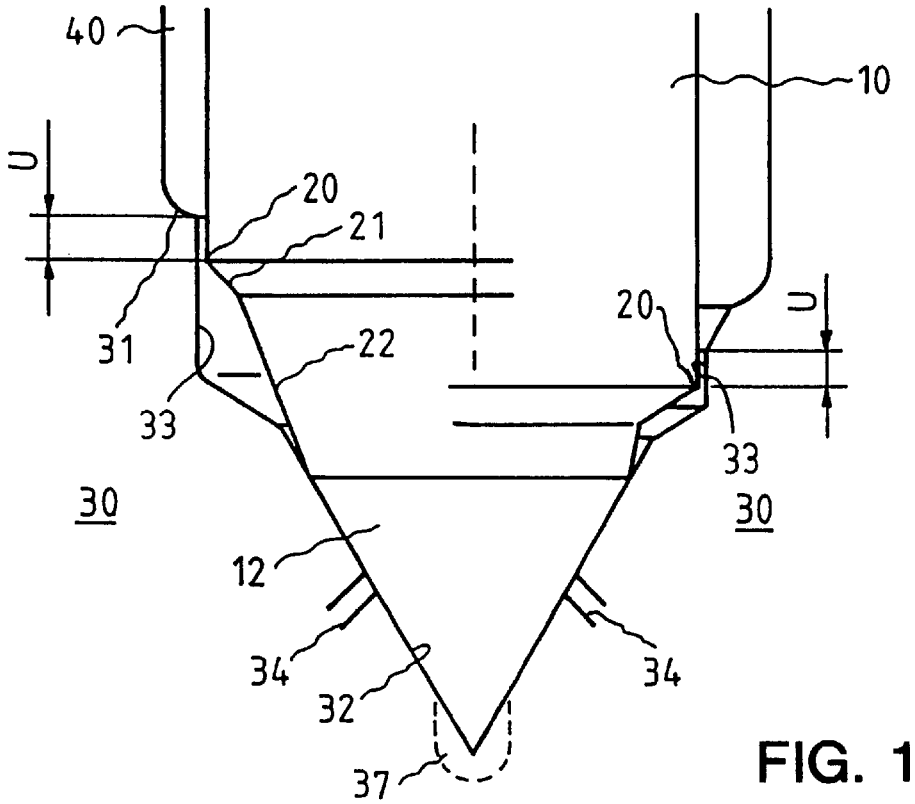
FIG. 1, in a half-sectional view and partly cut away, two exemplary embodiments of a fuel injection nozzle that makes use of the invention.

The lower region of an exemplary embodiment of a fuel injection nozzle for self-igniting internal combustion engines is shown in the left half of FIG. 1.

As seen in FIG. 1, the fuel injection nozzle has a nozzle body 30, in which a conical seat face 32 at which injection ports 34 originate is formed in the bottom of a blind bore 37. A valve needle is disposed axially displaceably in the blind bore 37; it is guided axially displaceably, counter to a closing force and counter to the fuel flow direction, by a guide portion (not shown) in the inlet region of the blind bore and on the end of a valve shaft 10 adjoining the guide portion the injection nozzle has a closing cone 12 that cooperates with the seat face 32.

The valve shaft 10 circumferentially defines an annular chamber 40, which serves to deliver fuel. In the transitional region between the valve shaft 10 and the closing cone 12, a throttle device of variable throttle cross section is disposed; by means of the throttle, the injection cross section can be varied as a function of the axial displacement of the valve needle. The throttle device includes a shoulder 31, formed in the annular chamber on the nozzle body 30, which narrows the annular chamber 40 to a smaller cylindrical portion 33, disposed downstream of the shoulder 31 in the blind bore 37 and a control edge 20, embodied slightly downstream on the valve shaft 10 of the valve needle, and two conical faces 21, 22 with different cone angles adjoin this control edge downstream of it.

The function of such a throttle device of variable throttle cross section is as follows: First, a first throttle cross section is realized by means of the spacing between the shoulder 31 and the control edge 20, and hence between the shoulder 31 and the valve shaft 10. By axial displacement of the valve shaft 10 counter to the flow direction of the fuel to be injected, or in other words upward in terms of FIG. 1, the throttle cross section initially does not change, until the control edge 20 has executed a stroke motion marked U in FIG. 1 and the control edge overtakes the shoulder 31. At that moment, the first conical face 21 is facing the shoulder 31, which because of its conicity leads to a increase in the throttle cross section upon a further axial displacement of the valve needle.

This throttle cross section increases still further as soon as the second conical face 22 begins to overtake the shoulder 31, so that with the further opening stroke motion of the valve needle, the overflow cross section from the annular chamber 40 to the injection ports 34 increase.

Figure 2:
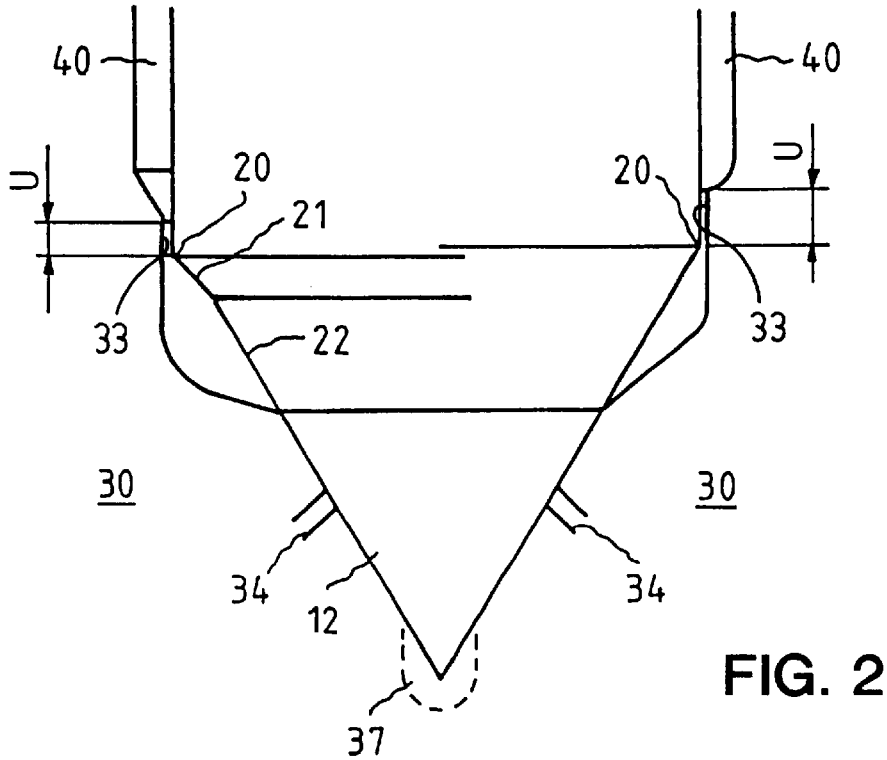
FIG. 2, each in a half-sectional view and partly cut away, two further exemplary embodiments of a fuel injection nozzle that makes use of the invention.

The exemplary embodiments shown in the right half of FIG. 1 and in the left and right halves of FIG. 2 differ from the above-described exemplary embodiment shown in the left half of FIG. 1 in that the control edge 20 and shoulder 31 are disposed differently. Those elements that are identical to those of the first exemplary embodiment shown in the left half of FIG. 1 are identified by the same reference numerals, and so the entire content of the description of the first exemplary embodiment is referred to for their description as well.

Figure 3:
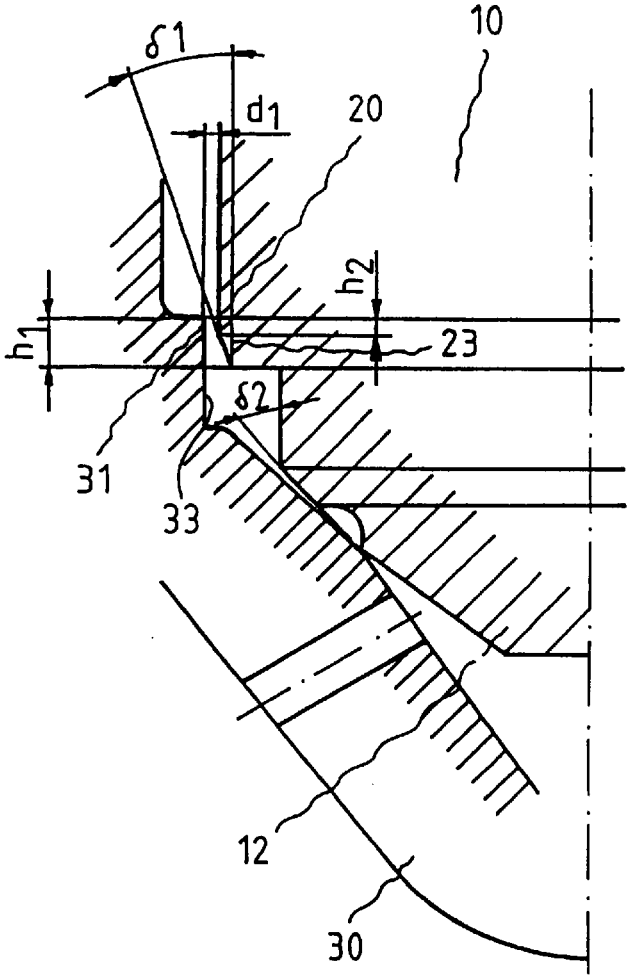
FIG. 3, a half-sectional view of a throttle device of a fuel injection nozzle that makes use of the invention.
Figure 3A:
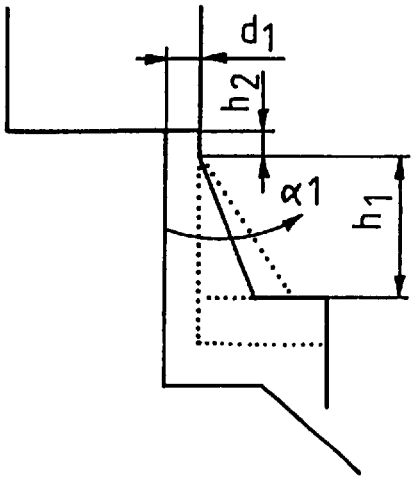
FIG. 3*a*, an enlarged detail of the throttle device shown in FIG. 3.

A further exemplary embodiment of a throttle device of variable throttle cross section, which is used particularly in injection nozzles for common rail injection systems, is shown in FIG. 3 and FIG. 3*a*.

In FIG. 3, those elements that are identical to those of the exemplary embodiments shown in the FIGS. 1 and 2 are identified by the same reference numerals, and so for their description, the descriptions of these exemplary embodiments are again referred to. The exemplary embodiment of a common rail fuel injection nozzle shown in FIG. 3 differs from the valve seat, known per se, used in common rail nozzles. The exemplary embodiment shown in FIG. 3 also differs from the exemplary embodiments shown in FIGS. 1 and 2 in that the control edge 20 embodied on the valve needle 10 faces the shoulder 31, formed on the valve body 30, substantially directly, being spaced apart from it by a distance d1. The control edge 20 is adjoined by a conical face 23, whose cone angle δ1 is smaller than the angle δ2 of the closing cone. Because of the gap formed by the spacing d1, the transition from the opening range to the prestroke range of the fuel injection nozzle is defined. This transition can also be varied by disposing the control edge 20 slightly below the shoulder 31 at a spacing h2.

By embodying the throttle device in this way, the closing cone 12 is included in the throttling function of the throttle device, as will now be described.

The function of the fuel injection nozzle shown in FIG. 3 and FIG. 3*a* is as follows: Initially, the closing cone 12 lifts slightly away from the valve seat 32, causing a gap to form between the closing cone 12 and the valve seat 32, the width of the gap being less than the spacing d1 between the control edge 20 and the shoulder 31. Because of these spacing ratios, the gap between the closing cone 12 and the valve seat 32 initially forms a throttle. Upon further axial displacement of the valve needle, the gap between the closing cone 23 and shoulder 31 on valve body 30 slowly becomes continuously and increasingly larger, approximately until such time as the conical face 23 adjoining the control edge 20 moves past the shoulder 31, or in other words until the valve needle 10 has executed an axial stroke of height h1. As a result, with an increasing stroke of the valve needle, a shallow rise in the injection cross section is made possible, this rise becoming greater as the axial stroke lengthens further, once the axial stroke of magnitude h1 has been executed.

As a result, not only is shaping of the injection course in an especially advantageous way made possible, but in particular disadvantageous deviations in the injection cross section because of production tolerances are eliminated.

Figure 4:
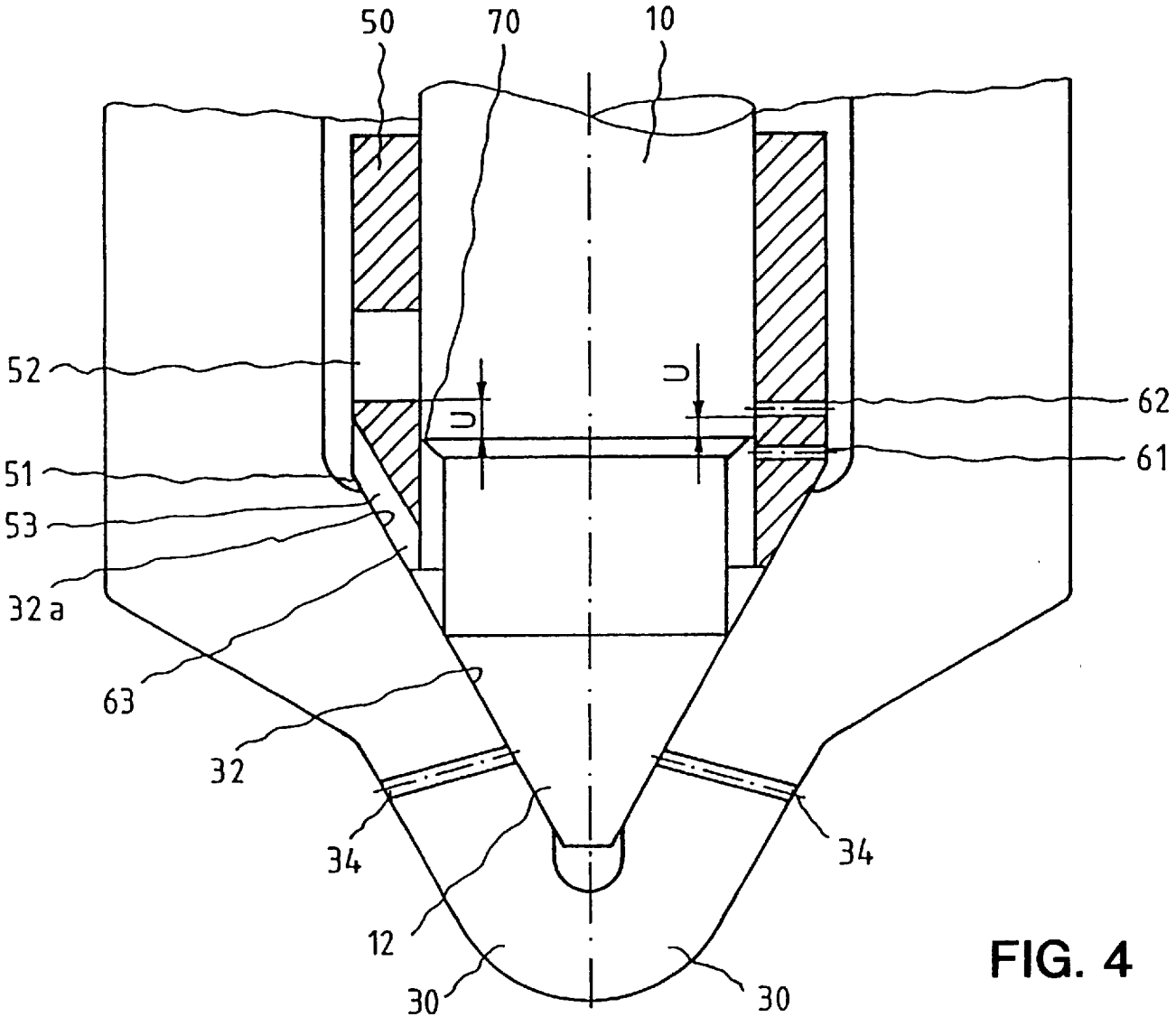
FIG. 4, each in a half-sectional view and partly cut away, two further exemplary embodiments of a fuel injection nozzle according to the invention.
Figure 5:
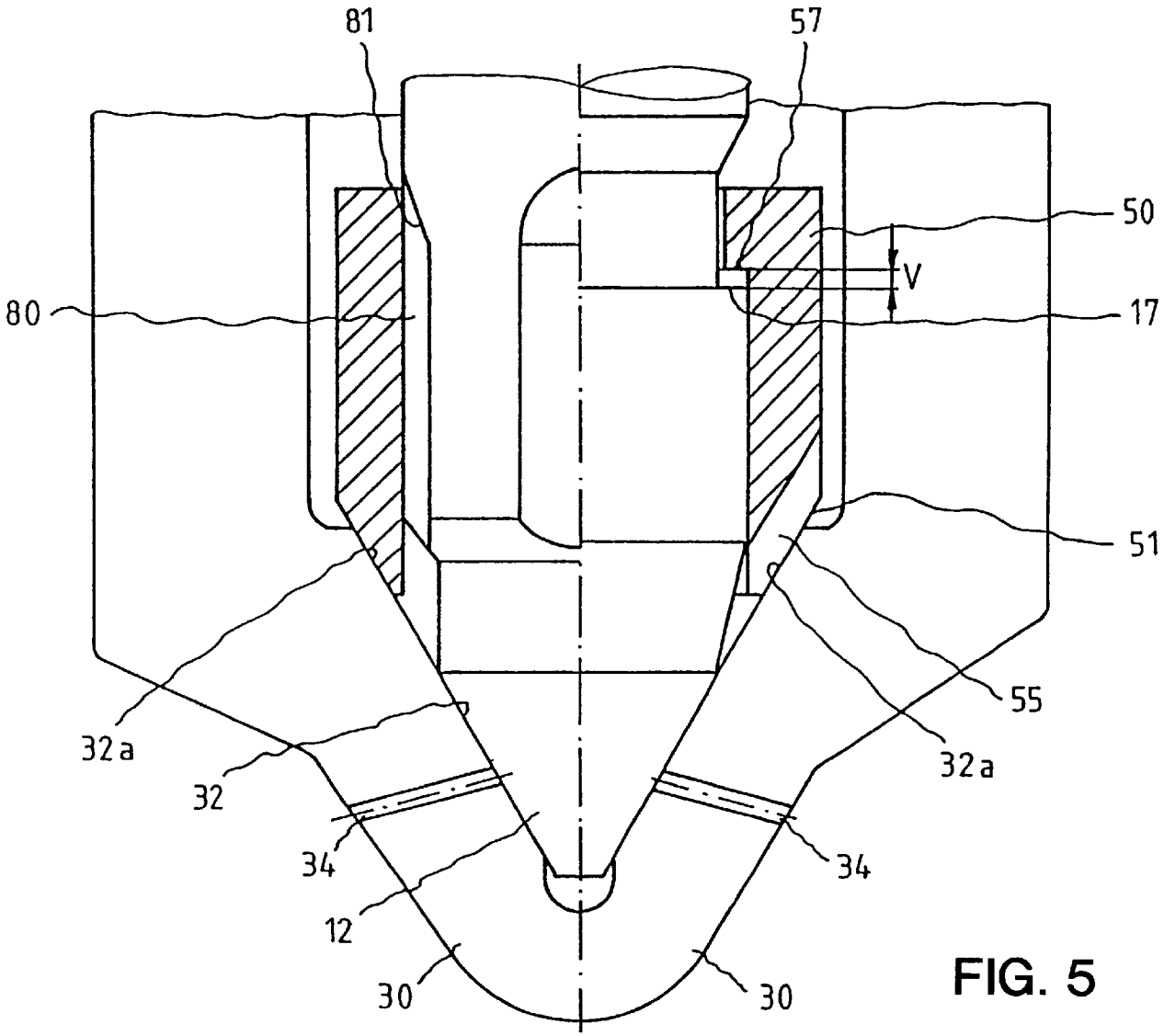
FIG. 5, each in a half-sectional view and partly cut away, two further exemplary embodiments of a fuel injection nozzle according to the invention.

Further exemplary embodiments of throttle devices for fuel injection nozzles are shown in FIGS. 4 and 5, in each case in a half-sectional view.

In the exemplary embodiments shown in FIGS. 4 and 5, those elements that are identical to those of the exemplary embodiments described above are identified by the same reference numerals, and for their description, once again the above descriptions of these exemplary embodiments are referred to. The exemplary embodiments shown in FIGS. 4 and 5 differ from the exemplary embodiments shown in FIGS. 1–3 in that instead of the embodiment of a shoulder 31 in the annular chamber 40, a sleeve 50 axially displaceably counter to the restoring force of a spring (not shown) is disposed in the annular chamber and rests with a conical face end on the outer annular face 32*a* of the conical seat face 32.

In the case of the sleeve 50 shown in the left half of FIG. 4, two openings 52 and 53 that can be uncovered in succession by axial displacement of the valve needle are provided in the sleeve, of which the first opening 52 is disposed in the jacket of the sleeve 50 and the second opening 53 is provided, for instance in the form of grooves, on the conically embodied face end 51. A control edge 70 is provided on the valve shaft 10; when the fuel injection nozzle is closed, this control edge is disposed at a predetermined spacing U below the first opening 52 having the larger opening cross section. In such a fuel injection nozzle, the opening 53 provided in the conical end face 51 initially acts as a throttle, which upon a slight axial displacement of the valve shaft 10 leads to an injection cross section determined by the opening cross section of the second opening 53. Upon a further axial displacement of the valve shaft 10, the control edge 70 overtakes the opening 52 of larger opening cross section disposed in the jacket of the sleeve 50, and as a result the injected fuel quantity increases continuously as the stroke motion of the valve shaft 10 lengthens.

In the exemplary embodiment shown in the right half of FIG. 4, the two openings of different opening cross sections are each formed by one row of perforations 61, 62; the downstream row of perforations 61 has a smaller total cross section than the upstream row of perforations 62.

In this case, the control edge 70 is located between the first and second rows of perforations 61, 62. By axial displacement of the valve shaft 10, the control edge 70 overtakes the upstream row of perforations 62 and opens it continuously as the stroke motion lengthens, and as a result the throttle cross section increases in size continuously as the stroke of the valve shaft 10 continues.

The exemplary embodiment shown in the left half of FIG. 5 differs from the exemplary embodiment shown in FIG. 4 in that a plurality of recesses 80 cooperating with the sleeve 50 are disposed facing the sleeve 50 in the valve shaft 10, and their opening cross section increases continuously toward the conical seat face on the end of the sleeve 50 remote from the closing cone 12 and oriented toward the guide portion (not shown) of the valve needle. This region 81 acts as a throttle of variable throttle cross section, which is increases continuously by a stroke motion of the valve shaft 10 in its opening direction.

In the exemplary embodiment shown in the right half of FIG. 5, the sleeve 50 is embodied such that it can be slaved by the valve shaft 10 by means of an axial displacement of the valve needle and thus of the valve shaft 10. To that end, the valve shaft 10 has a shoulder 17, which engages a protrusion 57 of the sleeve 50. In its conical face end 51, the sleeve So has recesses 55, which are open toward the face end and which act as a throttle cross section that does not change with increasing axial displacement of the valve shaft 10, until after shoulder 17 engages prostrusion 57. As shown in FIG. 5, the protrusion 57 is spaced apart from the shoulder 17 formed on the valve needle 10 in such way that the sleeve 50 is initially not slaved upon a stroke motion of the valve needle. In that case, the injected fuel quantity is guided by the openings 55 formed in the conical face end 51, which perform a throttling function.

The spacing of the protrusion 57 above the shoulder 17 is equivalent to a prestroke V of the fuel injection nozzle.

The above description pertains to an injection port nozzle, but it is understood that the invention is not limited to such an injection port nozzle and can be used in a blind bore nozzle as well, in a corresponding way.

The forgoing relates to a preferred exemplary embodiments of the invention, it being understood that other variants and embodiments thereof are possible within the spirit and scope of the invention, the latter being defined by the appended claims.

What is claimed is:

1. A fuel injection nozzle for self-igniting internal combustion engines, comprising a nozzle body (30), in which a conical seat face (32) is formed from which injection ports (34) originate at a bottom of a blind bore (37), a valve needle has a closing cone (12) that cooperates with the valve seat face (32), said valve needle is guided displaceably with a guide portion in a inlet region of the blind bore (37) counter to a closing force and counter to a fuel flow direction and on an end of a valve shaft (10) adjoining the guide portion, the valve shaft (10) circumferentially defining an annular chamber (40) for fuel delivery, in a transitional region between the valve shaft (10) and the closing cone (12), a throttle device of variable throttle cross section is disposed, in which the throttle device includes a shoulder (31), formed in the annular chamber (40), and a control edge (20) disposed adjacent to the shoulder and spaced apart from the shoulder on the valve shaft (10), said control edge is adjoined downstream by at least one conical face (21, 22), by which the injection cross section is varied as a function of an axial displacement of the valve needle.

2. The fuel injection nozzle in accordance with claim 1, in which the control edge (20) substantially faces the shoulder (30).

3. The fuel injection nozzle in accordance with claim 2, in which the at least one conical face (21, 22) adjoining the control edge (20) has a smaller cone angle than the conical seat face (20).

4. The fuel injection nozzle in accordance with claim 2, in which the at least one conical face (21, 22) adjoining the control edge (20) has a larger cone angle than the conical seat face (20).

5. The fuel injection nozzle in accordance with claim 1, in which the control edge (20) is disposed slightly downstream of the shoulder (31).

6. The fuel injection nozzle in accordance with claim 5, in which the at least one conical face (21, 22) adjoining the control edge (20) has a smaller cone angle than the conical seat face (20).

7. The fuel injection nozzle in accordance with claim 5, in which the at least one conical face (21, 22) adjoining the control edge (20) has a larger cone angle than the conical seat face (20).

8. A fuel injection nozzle for self-igniting internal combustion engines, comprising a nozzle body (30), in which a conical seat face (32) is formed from which injection ports (34) originate at a bottom of a blind bore (37), a valve needle has a closing cone (12) that cooperates with the valve seat face (32), said valve needle is guided displaceably with a guide portion in a inlet region of the blind bore (37) counter to a closing force and counter to a fuel flow direction and on an end of a valve shaft (10) adjoining the guide portion, the valve shaft (10) circumferentially defining an annular chamber (40) for fuel delivery, in a transitional region between the valve shaft (10) and the closing cone (12), a throttle device of variable throttle cross section is disposed, by which the injection cross section is varied as a function of an axial displacement of the valve needle, in which a sleeve (50) axially displaceable counter to the restoring force of a spring is disposed in the annular chamber (40) and rests with a conically embodied face end (51) on an outer annular face (32*a*) of the conical seat face (32), and at least two openings (52, 53; 61, 62) of different opening cross section are provided in said sleeve (50) in which the opening are uncovered in succession by axial displacement of the valve needle.

9. The fuel injection nozzle in accordance with claim 8, in which a first opening (52) is disposed above a control edge (70), formed on the valve shaft, in the jacket of the sleeve (50), and a second opening (53) of smaller opening cross section than that of the first opening (52) is disposed in the face end (51) embodied on the sleeve (50).

10. The fuel injection nozzle in accordance with claim 8, in which two rows of perforations (61, 62) one above the other are disposed in the jacket of the sleeve (50), and the downstream row of perforations (61) has a smaller total opening cross section than the upstream row of perforations (62), and a control edge (70) formed on the valve shaft (10) is disposed, in the closed state of the fuel injection valve, between the two rows of perforations (61, 62).

11. A fuel injection nozzle for self-igniting internal combustion engines, comprising a nozzle body (30), in which a conical seat face (32) is formed from which injection ports (34) originate at a bottom of a blind bore (37), a valve needle has a closing cone (12) that cooperates with the valve seat face (32), said valve needle is guided displaceably with a guide portion in a inlet reason of the blind bore (37) counter to a closing force and counter to a fuel flow direction and on an end of a valve shaft (10) adjoining the guide portion, the valve shaft (10) circumferentially defining an annular chamber (40) for fuel delivery, in a transitional region between the valve shaft (10) and the closing cone (12), a throttle device of variable throttle cross section is disposed, by which the injection cross section is varied as a function of an axial displacement of the valve needle, in which a sleeve (50) axially displaceable counter to the restoring force of a spring is disposed in the annular chamber (40) and rests with a conically embodied face end on the outer annular face (32*a*) of the conical seat face (32) and that facing the sleeve (50) in the valve shaft (10) is at least one recess (80), that cooperates with the sleeve (50), whose opening cross section, on the end of the sleeve (50) toward the guide portion, increases steadily toward the conical seat face.

12. A fuel injection nozzle for self-igniting internal combustion engines, comprising a nozzle body (30), in which a conical seat face (32) is formed from which injection ports (34) originate at a bottom of a blind bore (37), a valve needle has a closing cone (12) that cooperates with the valve seat face (32), said valve needle is guided displaceably with a guide portion in a inlet region of the blind bore (37) counter to a closing force and counter to a fuel flow direction and on an end of a valve shaft (10) adjoining the guide portion, the valve shaft (10) circumferentially defining an annular chamber (40) for fuel delivery, in a transitional region between the valve shaft (10) and the closing cone (12), a throttle device of variable throttle cross section is disposed, by which the injection cross section is varied as a function of an axial displacement of the valve needle, in which a sleeve (50), which is slaved by an axial displacement of the valve needle and is axially displaceable counter to the restoring force of a spring is disposed in the annular chamber (40) and rests with a conically embodied face end (51) on the outer annular face (32*a*) of the conical seat face (32), and its conically embodied face end (51) has at least one recess (55) that is open toward the face end.

13. A fuel injection nozzle for self-igniting internal combustion engines, comprising a nozzle body (30), in which a conical seat face (32) is formed from which injection ports (34) originate at a bottom of a blind bore (37), a valve needle has a closing cone (12) that cooperates with the valve seat face (32), said valve needle is guided displaceably with a guide portion in a inlet region of the blind bore (37) counter to a closing force and counter to a fuel flow direction and on an end of a valve shaft (10) adjoining the guide portion, the valve shaft (10) circumferentially defining an annular chamber (40) for fuel delivery, in a transitional region between the valve shaft (10) and the closing cone (12), a throttle device of variable throttle cross section is disposed, in which the throttle device includes a shoulder (31), formed in the annular chamber (40), and a control edge (20) disposed adjacent to the shoulder and spaced apart from the shoulder on the valve shaft (10), said control edge is adjoined downstream by at least one conical face (21, 22), by which the injection cross section is varied as a function of an axial displacement of the valve needle, wherein the throttle device includes a cylindrical portion (33) in the blind bore, and disposed downstream of the shoulder (31).

* * * * *